US006228003B1

(12) United States Patent
Hald et al.

(10) Patent No.: US 6,228,003 B1
(45) Date of Patent: May 8, 2001

(54) ADJUSTABLE DUMBBELL AND SYSTEM

(75) Inventors: Patrick J. Hald, Los Osos, CA (US); William T. Dalebout; F. Troy Miller, both of Logan, UT (US)

(73) Assignee: Icon Health and Fitness, Inc., Logan, UT (US)

( * ) Notice: Subject to any disclaimer, the term of this patent is extended or adjusted under 35 U.S.C. 154(b) by 0 days.

(21) Appl. No.: 09/042,755

(22) Filed: Mar. 17, 1998

(51) Int. Cl.[7] ..... A63B 21/075
(52) U.S. Cl. ..... 482/107; 482/108
(58) Field of Search ..... 482/93, 98, 106–108

(56) References Cited

U.S. PATENT DOCUMENTS

| | | | | |
|---|---|---|---|---|
| 4,529,198 | * | 7/1985 | Hettick, Jr. | 482/107 |
| 4,822,035 | * | 4/1989 | Jennings et al. | 272/123 |
| 5,637,064 | * | 6/1997 | Olson et al. | 482/108 |
| 5,769,762 | * | 6/1998 | Towley, III et al. | 482/93 |
| 5,779,604 | * | 7/1998 | Towley, III et al. | 482/108 |

FOREIGN PATENT DOCUMENTS

| | | | | |
|---|---|---|---|---|
| 1258447 | * | 9/1986 | (SU) | 482/93 |

OTHER PUBLICATIONS

PowerBlock, The Worlds' Only Selectorized Dumbbell, 1995 IntellBell, Inc.*

* cited by examiner

*Primary Examiner*—John Mulcahy
(74) *Attorney, Agent, or Firm*—Workman, Nydegger and Seeley

(57) ABSTRACT

A weight lifting system features (i) one or more weights; and (ii) a weightlifting bar configured to selectively engage the one or more weights. A weight of the present invention has an upstanding first end, an upstanding second end, and a cross member extending therebetween. Each of the first and second ends of the weight has an aperture therein. The weight lifting bar features (i) a handle having opposing ends; and (ii) a mechanism for selectively attaching each end of the handle to a corresponding end of the weight when the handle is disposed between the first end and second end of the weight. The mechanism for selectively attaching each end of the handle to a corresponding end of the weight preferably includes: (i) a pinion gear rotatably disposed within a channel of the handle; (ii) a first rod movably disposed within the channel; and (iii) a second rod movably disposed within the channel. Each rod has teeth formed along a length thereof which engage the pinion gear. By selectively moving one of the rods, the user manually advances both rods through opposing ends of the handle. Thus, the rods pass through the apertures in the first and second ends of the weight, removably coupling the weight to the handle.

27 Claims, 5 Drawing Sheets

ADJUSTABLE DUMBBELL AND SYSTEM

BACKGROUND OF THE INVENTION

1. The Field of the Invention

This invention is in the field of weight lifting equipment. More specifically, this invention is in the field of hand-held weights.

2. The Relevant Technology

Hand-held weights such as barbells and dumbbells have been used for many years by exercisers engaging in weight lifting. Some hand-held weight systems include a bar configured to removably receive a variety of different weights which slide onto the bar. Other weight systems include a handle and disks integrally attached on opposing sides of the handle.

It is common for commercial gyms and home gyms to include barbells or dumbbells which are stored on a bench or on the floor. These hand-held weights are used for exercises such as a military press to strengthen the upper body, curls to strengthen the biceps, squats to strengthen the upper and lower body. Sometimes dumbbells are held while jogging or running in place to enhance the exercise experience.

While lifting a weight which is too small may not provide the adequate training desired by a user, lifting a weight which is too heavy may strain or injure the user. The exerciser may be interested in lifting a lighter weight on one day, then ramp up to a heavier weight on another day. Thus, for the sake of safety and for the appropriate amount of exercise, it is useful to provide a variety of options for the exerciser.

In order to permit a number of different users to lift handweights, it is common for gyms to provide a variety of different weights and sizes of integral or adjustable weights. Despite the advantages of having a variety of different handweights, however, providing an assortment of different handweights is expensive and increases the amount of storage space required. In order to use space more efficiently, gyms typically include a shelf or cabinet for receiving differently-sized handweights.

In the event a weight bench or cabinet is not employed, the user is often forced to leave the weights on the floor, which is a highly inefficient use of space and provides a cluttered appearance. Thus, in order to use space more efficiently, the user is required not only to purchase the assortment of handweights but must also purchase a bench or cabinet for storing the various handweights.

Another problem within the art is that it is often cumbersome to mount weights onto a bar. Weights sometimes include holes therein and are disposed about the bar without being otherwise secured to the bar. One disadvantage with these weights is that it is possible for one or both of the weights on opposing sides of the bar to fall off. This can be inconvenient or even dangerous for the user or for a person adjacent to the user such as a spotter or coach.

For example, if the exerciser is lying on a bench performing a military press and a weight on one side of a bar falls off the bar, the weight on the other side of the bar causes the bar to tip toward the weighted side. If this action occurs suddenly, the non-weighted side can be quickly thrust toward the weighted side, possibly causing injury or damage.

In other embodiments, weights are prevented from falling from a bar through the use of screws disposed through circular brackets coupled outside the weights to the bar. These mechanisms, however, are often inconvenient to mount onto the bar and remove from the bar. Each of these mechanisms must be placed onto the bar separately and on opposing sides of the bar. Another problem within the art is the expense of purchasing separate pieces of equipment for each different weight desired to be used by the weightlifter.

One product known as the POWERBLOCK attempts to provide a selectorized dumbbell which allows a user to select a desired weight to be lifted from a set of stacked weights. A user inserts a core having an internal hand grip into a set of stacked weights, then selects a desired number of weights using a selector pin.

The POWERBLOCK however, interferes with the natural movement of the user's wrists and has an unusual rectangular block appearance. The user must reach into the rectangular structure to pick up the weights. As a result, the rectangular structure can inconveniently contact the wrists during use. In addition, the selector pin can be misplaced and is inconvenient to orient into and remove from the weights.

SUMMARY AND OBJECTS OF THE INVENTION

It is therefore an object to provide an improved weightlifting system.

It is another object of the invention to provide an improved weightlifting bar.

It is another object of the invention to provide an improved weight.

It is another object of the invention to provide a weightlifting system which selectively, conveniently allows a user to adjust the weight of the weightlifting system.

It is another object of the invention to provide a weightlifting system which includes a plurality of weights which are removably coupled to a weightlifting bar.

It is another object of the invention to provide a weightlifting bar which conveniently allows a user to add additional weights or remove excess weights from the weightlifting bar.

It is another object of the invention to eliminate unnecessary expense on separate pieces of weightlifting equipment.

It is another object of the invention to eliminate wasted storage space in exercise gyms.

The present invention relates to a weight lifting system comprising (i) one or more weights; and (ii) a weightlifting bar configured to selectively engage the one or more weights. A weight of the present invention has an upstanding first end, an upstanding second end, and a cross member extending therebetween. Each of the first and second ends of the weight has an aperture therethrough.

The weight lifting bar comprises (i) a handle having opposing ends; and (ii) means for selectively attaching each end of the handle to a corresponding end of the weight when the handle is disposed between the first end and second end of the weight. The means for selectively attaching each end of the handle to a corresponding end of the weight preferably comprises: (i) a pinion gear rotatably disposed within a channel of the handle; (ii) a first rod movably disposed within the channel; and (iii) a second rod movably disposed within the channel. Each rod has teeth formed along a length thereof which engage the pinion gear.

By selectively moving one of the rods, the user manually advances both rods through opposing ends of the handle. Thus, the rods pass through respective apertures in the first and second ends of the weight, removably coupling the weight to the handle.

The invention further includes a second weight configured to receive the first weight between the ends thereof in a nested relationship. In this nested relationship, the apertures in the upstanding ends of the first and second weights are in axial alignment. This allows the rods to pass through the apertures in both weights when the user desires to lift both weights. One or both weights is then conveniently removed from the weightlifting bar by manually retracting the rods out of one or both weights.

In one embodiment, the rods are advanced in desired increments out of opposing ends of the handle. In order to advance the rods in desired increments, the handle includes a plurality of longitudinally aligned slots formed within the channel. A knob on one of the rods is configured to selectively engage a pair of desired slots. This maintains each rod in a desired orientation with respect to the handle until the knob is selectively moved from that orientation to another pair of slots by the user. Each slot is separated by a tooth extending between neighboring slots. The knob is spring-loaded such that the knob is selectively depressed in order to move the knob between slots. Preferably, the handle includes first and second rows of longitudinally aligned slots.

The weightlifting system of the present invention enables the user to select a desired number of weights to be lifted, then readily couple the weights to the weightlifting bar without concern that the weights will fall off, and without having to screw brackets onto different sides of the bar and unscrew the brackets when adjustment is desired. If certain weights are not selected, they are maintained in a nested relationship with respect to each other, thereby conserving space. Furthermore, adjustment of the weights coupled to the handle can be accomplished using a single hand. The user conveniently presses a knob with the user's thumb or finger, thereby advancing the rods out of the handle and into a desired number of weights.

In addition, when the user desires to remove certain weights from the weightlifting bar, the user is able to readily do so and leave the excess weights in the nested relationship with other weights. The weightlifting system thus conserves space, provides for easy adjustment of weights, and maintains weights on the bar without risk of the weights falling off.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
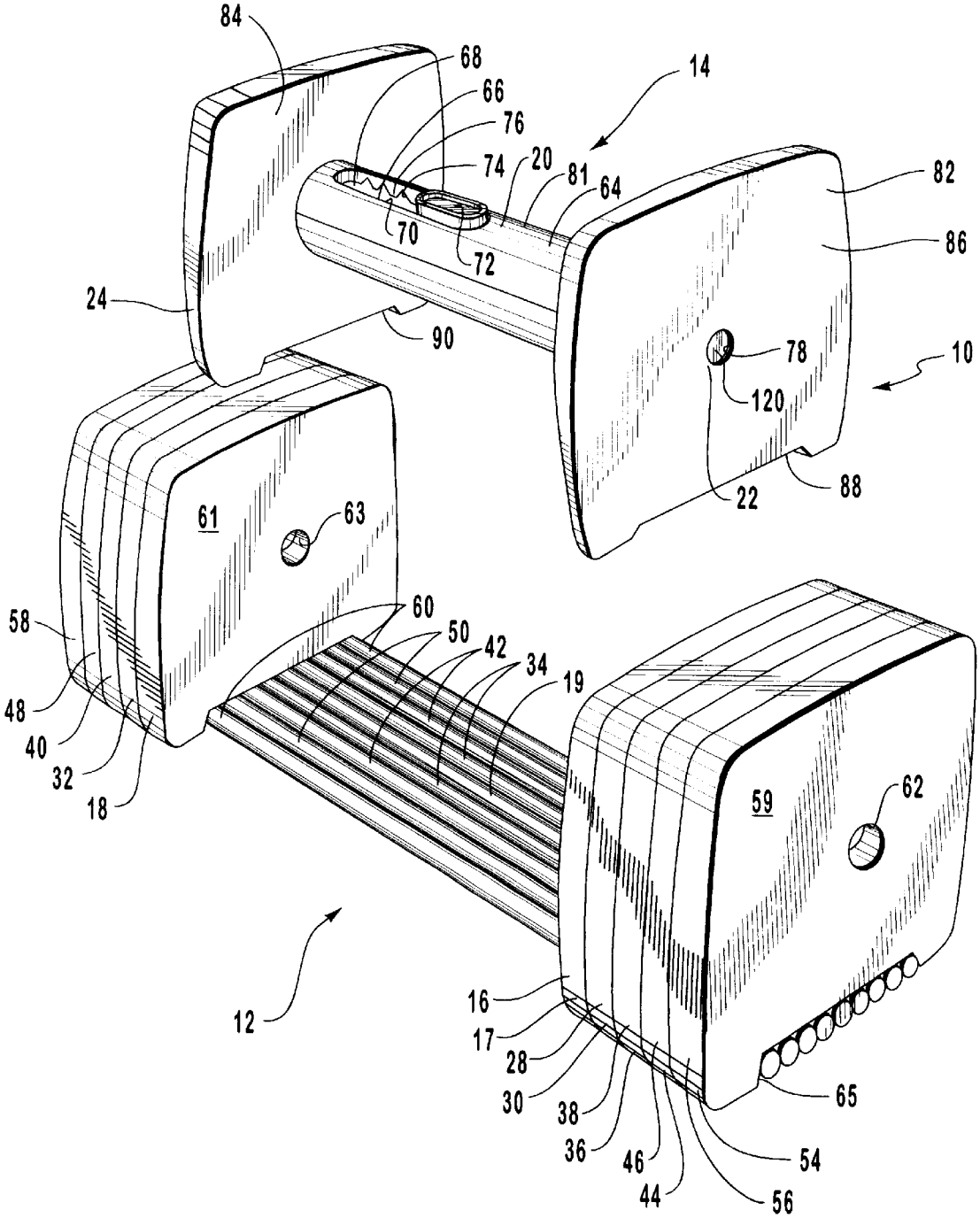
FIG. 1 is a view of one embodiment of the weightlifting system of the present invention with the weightlifting bar shown above a plurality of nested weights.

With reference now to FIG. 1, a weightlifting system 10 of the present invention is shown. Weightlifting system 10 comprises (i) one or more weights 12; and (ii) a weightlifting bar 14 configured to selectively engage the one or more weights 12. First weight 16 of weight nest 12 has a first upstanding end 17, a second upstanding end 18, and a cross member 19 extending therebetween.

Weightlifting bar 14 comprises (i) a handle 20 having first and second opposing ends 22, 24; and (ii) means for selectively attaching each end 22, 24 to a corresponding end 17, 18 of weight 16 when handle 20 is disposed between first end 17 and second end 18 of weight 16. Weightlifting bar 14 is readily placed between first and second ends 17, 18 of weight 16.

System 10 enables the user to select a desired number of weights 12 to be lifted, then conveniently couple the desired weights 12 to weightlifting bar 14. By placing bar 14 within first weight 16, then actuating the attaching means, the user selectively couples one or more weights 12 to bar 14. The user may couple one, two, three, four, five or even more weights 12 to bar 14, depending upon the amount of weight desired to be lifted by the user. If certain weights are not selected by a user, they are maintained in a nested relationship with respect to each other, thereby conserving space. In addition, when the user desires to remove certain weights from weightlifting bar 14, the user is able to readily release the weights from bar 14 and leave the weights in the weight nest 12. System 10 thus conserves space, provides for easy adjustment of weights 12, and maintains weights on bar 14 without risk of weights 12 falling off.

Weights 12 will now be discussed in additional detail. First weight 16 is shown in FIG. 1 as being nested within second weight 28. Second weight 28 has a first end 30, a second end 32, and a pair of cross members 34 extending between first end 30 and second end 32. A third weight 36 has a first end 38, a second end 40 and a pair of cross members 42 extending between first and second ends 38, 40. A fourth weight 44 includes a first end 46, a second end 48, and a pair of cross members 50 extending between first and second ends 46, 48. A fifth weight 54 includes first and second ends 56, 58 and a pair of cross members 60 extending between first and second ends 56, 58.

It will be appreciated that a number of additional weights may be added in the nested relationship between weights 16, 28, 36, 44 and 54. It will also be appreciated that one, two, three or more cross members may be disposed between ends of weights.

Each of the upstanding ends of first and second ends of weights 16, 28, 36, 44 and 54 is preferably comprised of a disk having an aperture 62, 63 extending therethrough. The disk may be a variety of different shapes, sizes or configurations but preferably has planar side faces 59, 61 on opposing sides thereof in order to conveniently and efficiently enable neighboring ends of weights to mate with and be stacked next to each other and to allow weightlifting bar 14 to be disposed between first and second ends 17, 18 of weight 16. In addition, each disk has a slot 65 in a lower portion thereof which receives each cross member corresponding to each disk and allows inner weights to nest atop cross members of neighboring weights.

Cross members 19, 34, 42, 50 and 60 may be coupled to respective weights 16, 28, 36, 44, 54 in a variety of different manners such as by being integrally connected to respective first and second ends, by being welded to respective ends, by being bolted or screwed into respective ends, or in a variety of other methods as is known by those skilled in the art. By being coupled to the lower portions of the first and second upstanding ends of their respective weight, such as by being coupled to the lower surface (as shown in FIG. 1) of the upstanding ends or by being coupled to the lower inside portion of the upstanding ends, the cross members avoid interference with the wrist of the user.

As mentioned, each end of each weight has an aperture 62, 63 extending therethrough. Each weight is also configured such that the apertures 62 in the first upstanding ends of each weight in the nest 12 are in axial alignment and such that the apertures 63 in the second upstanding ends of each weight in the nest 12 are in axial alignment. For example, second weight 28 is configured to receive first weight 16 between ends 30, 32 such that the apertures in the ends 17, 30 are in axial alignment and such that the apertures in ends 18, 32 are in axial alignment.

Since each aperture extending through respective first ends of weights 16, 28, 36, 44 and 54 has the same size and axis as neighboring apertures, a single passageway 62 is formed through each of the first ends of weights 16, 28, 36, 44 and 54. Similarly, since each aperture extending through respective second ends of weights 12, 28, 36, 44 and 54 has the same size and axis as neighboring apertures, a single passageway 63 is formed through each of the second ends of weights 16, 28, 36, 44 and 54. This alignment allows rods from bar 14 to be selectively disposed through one or more weights, as will be discussed in greater detail below.

Weightlifting bar 14 will now be described in additional detail with continued reference to FIGS. 1 and 2. Handle 20 of weightlifting bar 14 has (i) an exterior surface 64; and (ii) an interior surface 66 defining a channel 68 extending between first end 22 and second end 24.

As mentioned above, weightlifting bar 14 includes means for selectively attaching each end 22, 24 of handle 20 to a corresponding end 17, 18 of weight 16 when handle 20 is disposed between first end 17 and second end 18 of weight 16. In the embodiment shown in FIGS. 1 and 2, the means for selectively attaching each end 22, 24 of handle to a corresponding end 17, 18 of weight 16 comprises (i) first and second rods 94, 98 movably disposed within the channel 68 of handle 20; and (ii) means for selectively advancing the first and second rods 94, 98 out of opposing ends of handle 20.

Figure 2:
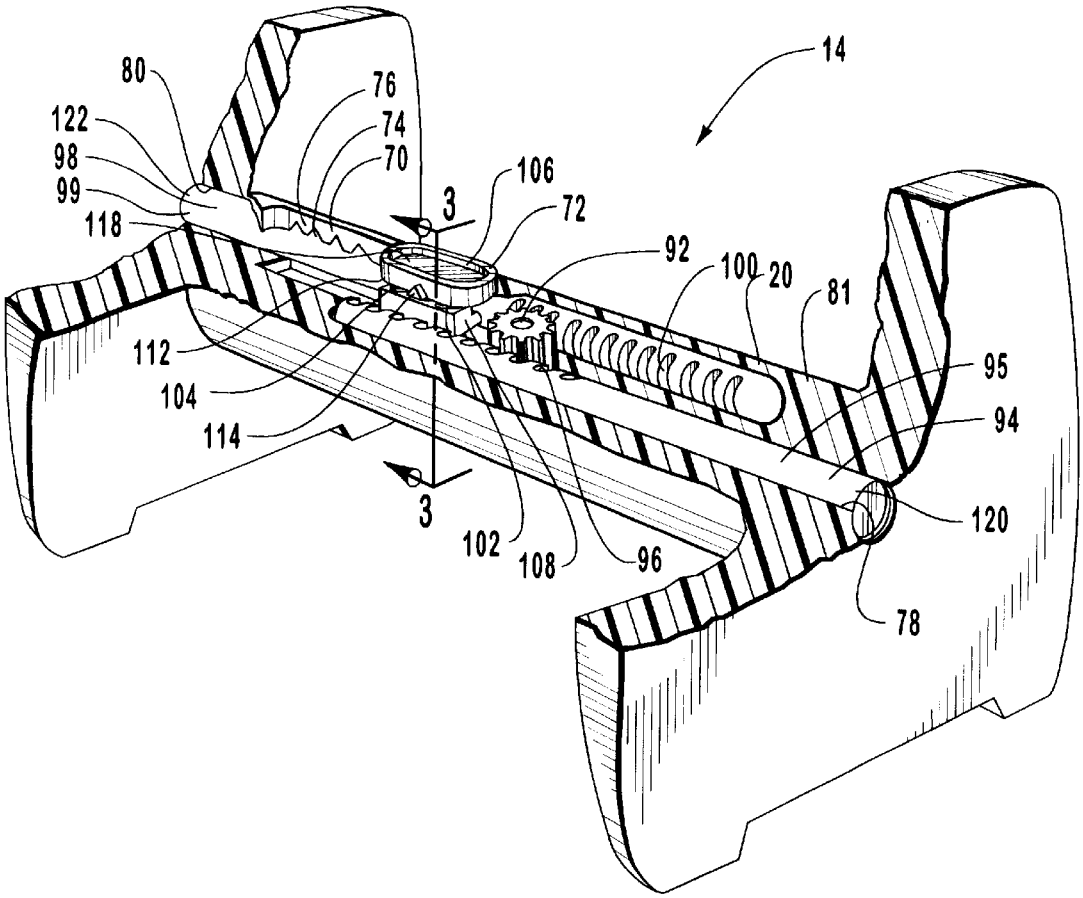
FIG. 2 is a cutaway view of the weightlifting bar of FIG. 1.

In the embodiment shown in FIGS. 1 and 2, the means for selectively advancing the first and second rods 94, 98 out of handle 20 comprises a pinion gear 92 rotatably disposed within channel 68 of handle 20. First rod 94 has a first end 95 positioned at the first end 22 of the handle and an opposing second end having teeth 96 formed along a length thereof, teeth 96 engaging pinion gear 92. Second rod 98 has a first end 99 positioned at the second end 24 of handle 20 and an opposing second end having teeth 100 formed along a length thereof. Teeth 100 of second rod 98 engage pinion gear 92 on a side opposite first rod 94. Pinion gear 92 is pivotally coupled to interior surface 66 of handle 20 through the use of a pin (not shown) disposed through gear 92 and coupled to interior surface 66.

In one embodiment, the invention further comprises means for selectively advancing the first and second rods 94, 98 in desired increments out of opposing ends 22, 24 of handle 20. This selectively retains rods 94, 98 in a desired, locked position and may also permit the user to select one additional weight for each increment used, for example.

Figure 3:
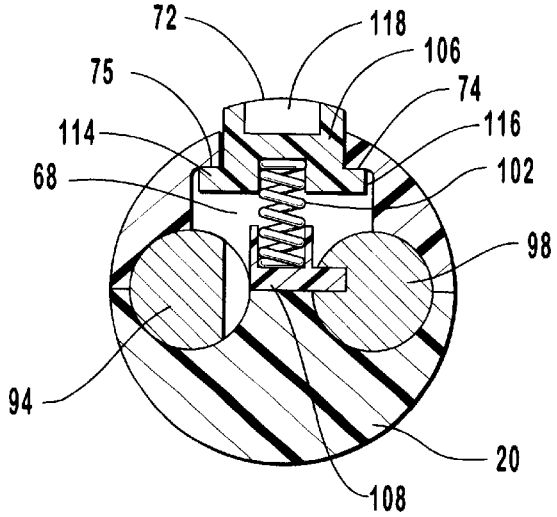
FIG. 3 is a cross-sectional view of the grip of the weightlifting bar shown in FIG. 2 demonstrating a spring-loaded knob which selectively engages a pair of desired slots within the grip.

With reference to FIGS. 1–3, in one embodiment the means for selectively advancing rods 94, 98 in desired increments comprises a springloaded knob 72 coupled to first rod, or, as shown in FIGS. 1–3, second rod 98. Knob 72 selectively engages one of a plurality of longitudinally aligned slots 74 formed along one side of channel 68 and, preferably, one of a plurality of longitudinally aligned slots 75 formed along another side of channel 68. Handle 20 thus preferably includes first and second rows of longitudinally aligned slots 74, 75 formed within the channel, each slot being separated by a tooth 76. Only the first row 74 is featured in FIG. 2, but handle 20 includes an identical row of slots 75 on an opposing side of channel 68. FIG. 3 depicts knob 72 as engaging a pair of slots, 74, 75 one from each of the rows of slots.

Knob 72 is thus preferably configured to selectively engage a pair of desired slots on opposing sides of channel 68, thereby maintaining rods 94, 98 in a desired orientation with respect to handle 20 until knob 72 is selectively moved from the pair of slots by a user. Springloaded knob 72 is selectively depressed in order to move knob 72 between slots.

As shown in FIGS. 2 and 3, knob 72 includes a button 106 and first and second flanges 114, 116 extending from button 106 and configured to selectively engage respective first and second slots 74, 75. Depression of button 106 enables flanges 114, 116 to bypass teeth 76 as knob 72 is adjusted as desired by the user. Thus, if the user desires to lift additional weight, the user moves knob 72 further toward end 24, thereby advancing rods 94, 98 further from handle 20 into additional weights.

As shown in FIGS. 1 and 2, channel 68 includes three openings. Knob 72 selectively moves back and forth within first opening 70 of channel 68. Rod 94 selectively extends through a second opening 78, while rod 98 selectively extends through a third opening 80 in handle 20.

An example of means for coupling knob 72 to rod 98 will now be described with reference to FIGS. 2 and 3. As shown, L-shaped member 108 is disposed within a recess within rod 94. L-shaped member 108 has first and second recesses for receiving first and second springs 102, 104 and a third recess between the first and second recesses for receiving a cylindrically shaped guide pin (not shown in FIGS. 2 and 3). Knob 72 also has recesses in the lower surface 112 thereof for receiving springs 102, 104. In one embodiment, the guide pin extends integrally from the lower surface 112 of knob 72 between springs 102, 104.

The guide pin insures the smooth, aligned movement of knob 72 along a substantially perpendicular axis with respect to the longitudinal axis of handle 20. Springs 102, 104 allow button 106 to be selectively depressed when desired by the user, but maintain knob 72 a nondepressed, desired orientation when knob 72 is not compressed by the user. Button 106 includes an upper recess 118 for placement of the thumb or finger of the user therein, thereby allowing the user to more readily push button 106 to a desired orientation.

Upon depressing button 106, tabs 114, 116 are released from respective slots 74. Thus, knob 72 is freely movable within cavity 68. Upon longitudinal movement of knob 72, second rod 98 moves within cavity 68, causing first rod 94 to move in an opposing direction within cavity 68. Upon outward movement of rod 94, the outer tip 120 of rod 94 extends through opening 78 and into first end 17 of weight 16. Similarly, upon movement of rod 98 outward through opening 80, outer tip 122 of rod 98 is moved into second end 18 of weight 16. Upon further outward movement of knob 72, outer tips 120, 122 of first and second rods 94, 98, respectively, extend into weights 28, 36, 44, 54 and so on as desired while weightlifting bar 14 is disposed within weight nest 12.

In order to selectively remove weights from weightlifting bar 14, outer ends 120, 122 are selectively retracted into weightlifting bar 14 by depressing button 106, then sliding button 106 toward the center of handle 20, thereby retracting rods 94, 98 and allowing the desired weights to slide off weightlifting bar 14. In one embodiment, by moving in selected increments, rods 94, 98 pick up or release successive weights.

It will be appreciated that rods 94, 98 may be advanced manually without knob 72 by pressing against one of rods 94, 98, for example. Thus, one embodiment of the means for selectively advancing rods 94, 98 comprises first and second rods 94, 98 and pinion gear 92 without knob 72.

Also as shown in FIGS. 1–3, in one embodiment, handle 20 comprises (i) a cylindrically-shaped, hollow grip 81; and (ii) first and second end plates 82, 84 coupled to opposing sides of grip 81. End plates 82, 84 are preferably flat on the exterior surfaces 86 thereof, thereby providing a smooth mating surface corresponding to the ends of weights 12. However, it will be appreciated that end plates 82, 84 are optional and that weights 12 may also be coupled to handle 20 by being coupled directly to grip 81.

End plates 82, 84 include a respective lower slot 88, 90 which receives cross-members 19, 34, 42, 50 and 60. Thus, weightlifting bar 14 can be conveniently placed in a mating relationship with weight 16 when weightlifting bar 14 is lowered onto the nest of weights 12. Slots 88, 90 also assist by orienting rods 94, 98 into respective apertures 62, 63 when handle 20 is placed onto the cross members of weights 12.

Figure 4:
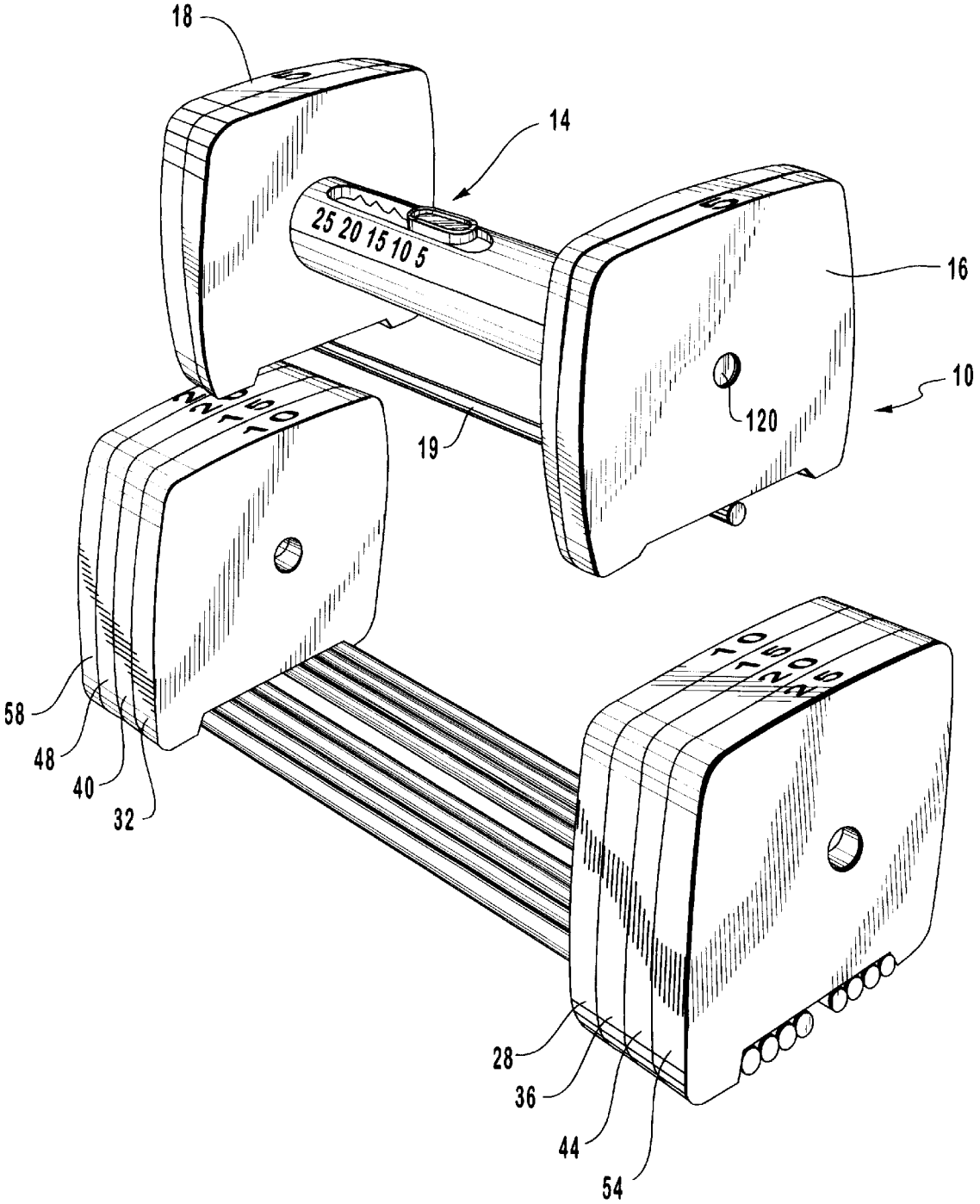
FIG. 4 is a view of the weightlifting bar of FIG. 1 having one of the weights from the weight nest shown in FIG. 1 coupled thereto.

With reference now to FIG. 4, the placement of weight 16 on weightlifting bar 14 is demonstrated. Upon placement of weightlifting bar 14 into the remaining nest of weights 28, 36, 44, 54, weight 16 may be deposited conveniently within the nest or, optionally, additional weights 28, 36, 44, and/or 54 may be grasped by weightlifting bar 14. In one embodiment, ends 120, 122 of rods 94, 98 are tapered at the tips thereof to permit smooth sliding thereof into the ends of desired weights.

Adjustment of the weights coupled to handle 20 may be accomplished using a single hand. Once handle 20 is disposed within weight 16, the user conveniently presses knob 72 (or, optionally one of rods 94, 98) with the user's thumb or finger, thereby advancing rods 94, 98 out of handle 20 and into a desired number of weights. This one-handed weight adjustment capability has many advantages. The user is not required to release the handle 20 in order to adjust the weight. The user may use one hand to hold handle 20 and adjust the weight thereon while another hand performs another operation. In addition, it is possible for the user to hold two different handles 20, i.e., by holding one in each hand, and simultaneously adjust the number of weights on each handle 20.

As further shown in FIG. 4, the weights may have their respective weights stamped thereon or otherwise displayed in order to show the user the total amount of weight lifted. It will also be appreciated that although knob 72 is shown in FIGS. 1–4 as extending slightly above grip 81 of handle 20, it is possible to orient knob 72 within channel 68 such that knob 72 does not extend above grip 81 during use.

In the embodiments shown in FIGS. 1–4, rods 94, 98 are essentially cylindrical. In another embodiment, however, the rods are D-shaped, having a flat surface in which the teeth for coupling with a pinion gear are formed. In this alternative embodiment, there is a corresponding D shape of the holes within the ends of the weights.

Figure 5:
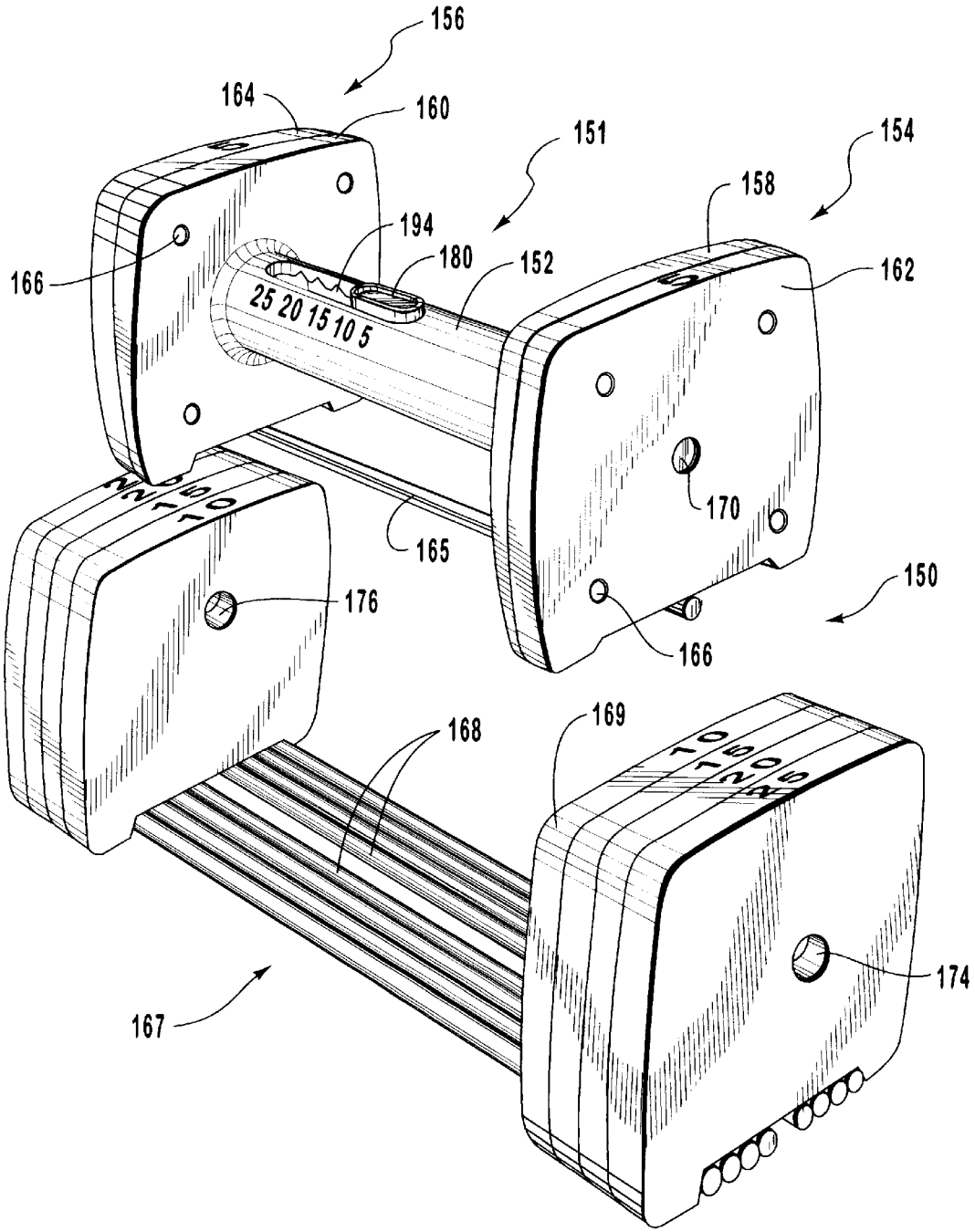
FIG. 5 is a view of yet another embodiment of a weightlifting system of the present invention comprising a handle having a weight affixed thereto.
Figure 6:
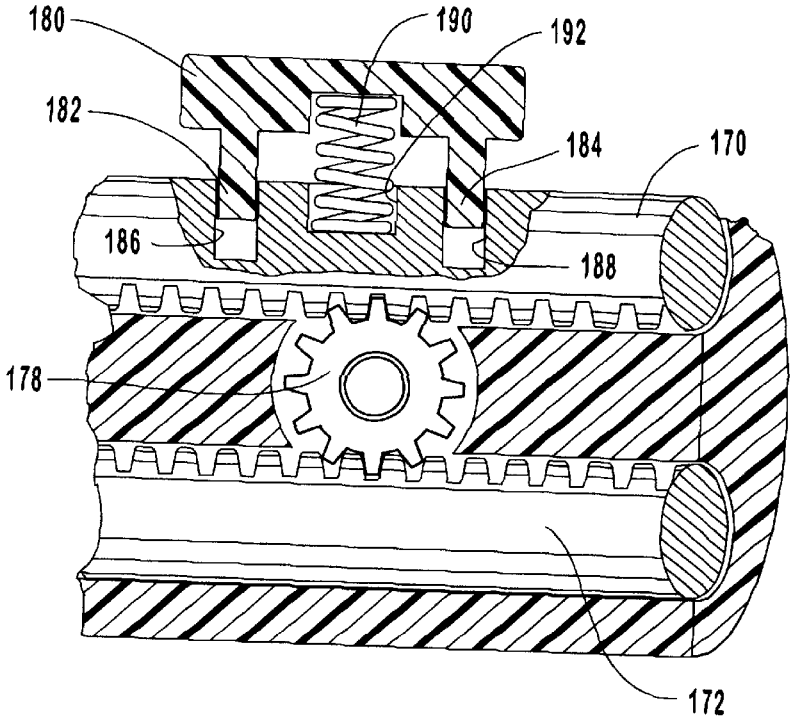
FIG. 6 is a cross sectional, cutaway view of one example of the means for selectively attaching each end of the handle to a corresponding end of the weight when the handle is disposed between the first and second ends of the weight.
Figure 7:
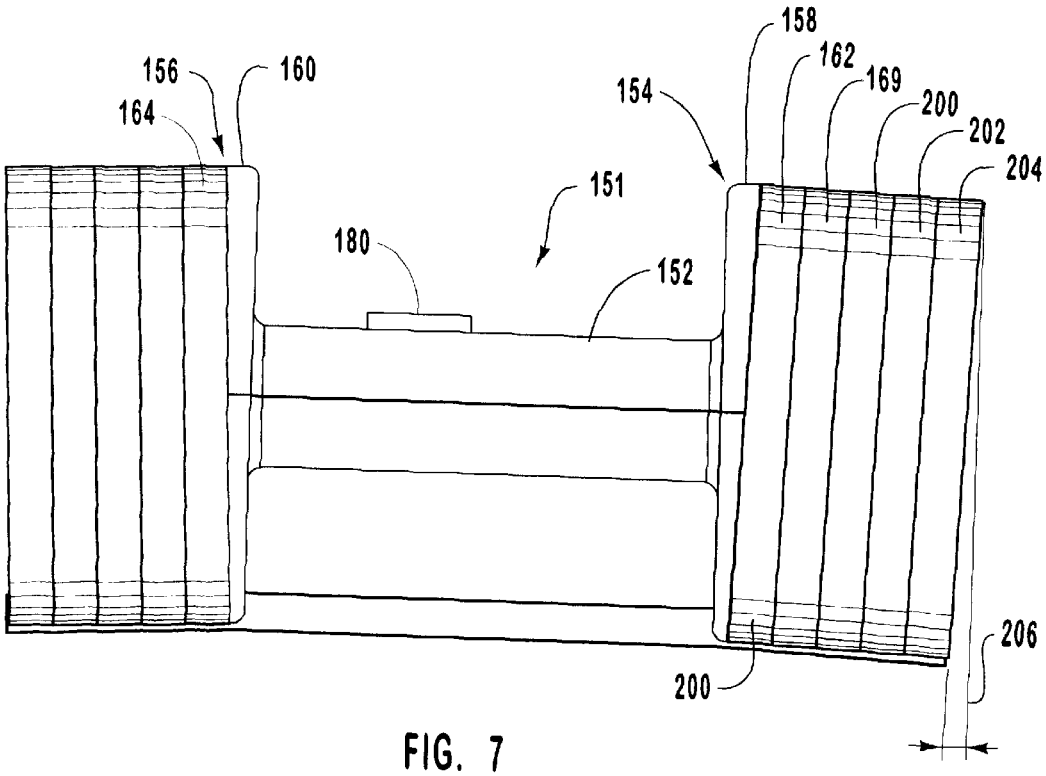
FIG. 7 is a view of the weightlifting system of FIG. 5 showing the handle of the system disposed within the weight nest of the system.

With reference now to FIGS. 5–7, another embodiment of present invention is shown. In the embodiment of the weightlifting system 150 shown in FIG. 5, handle 151 comprises a grip 152 and end plates 154, 156 extending from grip 152. End plates 154, 156 of handle 151 are each comprised of a respective first end plate portion 158, 160 and a respective second end plate portion 162, 164. Second end plate portion 162, 164 is substantially similar to first and second ends 17, 18 of weight 16 shown in FIG. 1.

In the embodiment of FIG. 5, however, fasteners 166 such as screws or bolts or other fasteners are disposed through second end plate portions 162, 164, thereby affixing portions 162, 164 to respective first portions 158, 160. This adds additional weight, such that in one embodiment handle 151 with its portions 162, 164 weighs more than handle 20 for additional resistance in exercising with handle 151. In one embodiment, first end plate portions 158, 160 extend integrally from grip 152. Grip 152 and first and second end plate portions 158, 160 may be comprised of a plastic or metal material, for example. In one embodiment, grip 152 and portions 158, 160 are manufactured in first and second half sections which are combined by being screwed or bolted together (the screws or bolts extending between half sections of the grip) to form a single unit.

In addition, handle 151 further includes a cross member 165 disposed between portions 162, 164, assisting in indexing handle 151 when handle 151 is placed within weight nest 167. When cross member 165 is placed in the appropriate location between cross members 168 of weight 169 of nest 167, the rods 170, 172 of handle 151 are properly aligned 119 to be placed within respective apertures 174, 176 of weights 167.

FIG. 6 is a cross sectional, cutaway view of another example of means for selectively attaching each end of handle, such as handle 151, to a corresponding end of weight, such as weight 169 when handle 151 is disposed between the first and second ends of the weight. As shown in FIG. 6, in one embodiment first and second rods 170, 172 are aligned vertically within handle 151, the pinion 178 being disposed between rods 170, 172.

Also as shown, as another embodiment of a means for coupling knob 180 to rod 170, knob 180 has guide pins 182, 184 extending integrally therefrom which couple directly into respective recesses 186, 188 within rod 170. A spring 190 is disposed between knob 180 and another recess 192 in rod 170, thereby springloading knob 180. Knob 180 further includes a flange (not shown) which selectively engages a pair of slots 194 (see FIG. 5) within first and second longitudinal rows of slots in handle 151 (second row not shown).

FIG. 7 demonstrates weights 169, 200, 202, 204 being removably coupled to handle 151. As shown in FIG. 7, in one embodiment, each end of each weight 169, 200, 202, 204 and the outer faces of end plates 154, 156 are oriented slightly at an angle outwardly with respect to an axis 206 perpendicular to the longitudinal axis of the grip 152, thereby enabling the weights to conveniently fit within each other and receive bar 151. In another embodiment, the angle is more dramatic.

Yet another example of the means for selectively attaching each end of the handle to a corresponding end of the weight when the handle is disposed between the first end and second end of the weight comprises a single rod moving within the handle rather than two rods having a pinion therebetween.

For example, in one embodiment, a single rod is movably disposed within the channel of the handle. The rod is selectively advanced out of a first end of the handle, by pressing against a springloaded knob on the rod, for example, or by pressing against the rod without a knob. Thus, in the single rod embodiment, the means for selectively advancing the rod may comprise the rod being configured to be pressed by the user out of an aperture in the handle, for example. The springloaded knob may be incrementally advanced within one or more slots in the channel as discussed above with reference to FIGS. 1–4, for example. In one embodiment, the second end of the handle is configured to fit within the aperture of a one end of a weight such as weight 16. Upon placing the second end into one end of the weight such as end 17, then advancing the rod out of the first end of the handle into the second end 18 of the weight, both ends of the handle are selectively coupled to the weight.

The weight lifting system of the present invention has many advantages over previous weightlifting systems. The weightlifting bar may be readily placed within a variety of different weights in order to selectively lift one or more of the weights, thereby allowing the user to select fewer or more weights as desired. The weights are retained within a nested relationship in order to conserve space and the weights are readily placed onto or removed from the weightlifting bar, thereby allowing quick and efficient placement of weights onto the bar and permitting quick and efficient removal of weights therefrom.

Another advantage is that in one embodiment, the weights are weighted equally on opposing sides thereon thereby providing even weight distribution upon being lifted by a user. Another advantage is that both sides of a weight may be added at the same time. Yet another advantage is that a weight may be added to the handle merely by pushing a button in the intermediate portion of the handle once the handle has been disposed within the weight.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A weight lifting system, comprising:

a weight having an upstanding first end and an upstanding second end;

a handle having opposing ends;

an extendable element selectively extending from each end of the handle; and means for simultaneously extending the extendable elements to engage the weight when the handle is disposed between the first end and second end of the weight;

wherein the handle comprises: (i) a grip having first and second ends; (ii) first and second end plates coupled to respective first and second ends of the grip, the first and second ends of the grip being coupled to respective central portions of the first and second end plates, such that the opposing first and second ends of the grip are located away from the peripheral edges of the respective end plates; and (iii) a channel in the grip, the extendable elements being movably disposed within the channel.

2. A system as recited in claim 1, wherein each of the first and second ends of the weight has an aperture extending therethrough.

3. A system as recited in claim 2, wherein the means for simultaneously extending the extendable elements to engage the weight comprises a pinion gear rotatably disposed within a channel of the grip; and the extendable elements comprise:

a first rod movably disposed within the channel of the grip, the first rod having a first end positioned at a first end of the grip and an opposing second end having teeth formed along a length thereof, the teeth engaging the pinion gear; and a second rod movably disposed within the channel of the grip, the second rod having a first end positioned at a second end of the handle and an opposing second end having teeth formed along a length thereof, the teeth of the second rod engaging the pinion gear on a side opposite the first rod.

4. A system as recited in claim 3, further comprising means for selectively advancing the rods in desired increments out of opposing ends of the grip.

5. A system as recited in claim 2, wherein the grip is configured to be grasped by a user, the grip having a channel and wherein each extendable element comprises a rod movably disposed within the channel of the grip and wherein the means for simultaneously extending the extendable elements to engage the weight comprises means for selectively advancing the rods out of opposing ends of the grip such that the rods selectively pass through the apertures in the first and second ends of the weights.

6. A system as recited in claim 1, wherein the ends of the handle have surfaces which correspond to the ends of the weight.

7. A system as recited in claim 1, wherein a cross member extends between the opposing ends of the handle; and wherein a plurality of cross members extend between the upstanding first and second ends of the weight, such that the cross member extending between opposing ends of the handle is disposed adjacent and between the cross members of the weight when the handle is placed between the first and second upstanding ends of the weight.

8. A system as recited in claim 1, wherein the first end of the weight comprises a first disk and the second end of the weight comprises a second disk, each disk having an aperture therein.

9. A system as recited in claim 1, wherein a cross member is coupled between the first upstanding end and the second upstanding end of the weight.

10. A weight lifting system, comprising:

a first weight having an upstanding first end with an aperture extending therethrough, an upstanding second end with an aperture extending therethrough, and a cross member extending between the first end and the second end;

a second weight having an upstanding first end with an aperture extending therethrough, an upstanding second end with an aperture extending therethrough, and a cross member extending between the first end and the second end, the second weight being configured to receive the first weight between the ends thereof such that the apertures in the upstanding first ends of the respective first and second weights and the apertures in the upstanding second ends of the respective first and second weights are in axial alignment;

a handle comprising:

a grip configured to be grasped by a user, the grip having a channel extending from a first end of the grip to an opposing second end of the grip; and first and second end plates coupled to the opposing first and second ends of the grip, respectively, the grip being coupled to a central portion of each of the first and second end plates such that the opposing first and second ends of the grips are located away from the peripheral edges of the respective end plates;

a pair of rods movably disposed within the channel of the grip; and means for selectively, simultaneously advancing the rods out of opposing ends of the handle such that the rods selectively pass through the corresponding apertures of the weights.

11. A weight lifting system as recited in claim 10, wherein the means for selectively simultaneously advancing the rods out of opposing ends of the grip comprises a knob slidingly engaged with the grip and coupled to at least one rod of the pair of rods movably disposed within the channel.

12. A system as recited in claim 11, wherein the first weight is nested into the second weight.

13. A system as recited in claim 11, wherein the means for selectively, simultaneously advancing the rods out of opposing ends of the grip comprises each rod having teeth formed along the length thereof, and further comprises a pinion gear pivotally coupled to the grip, the pinion gear disposed between the rods, the teeth of each rod engaging the pinion gear.

14. A system as recited in claim 11, wherein the ends of the first weight have surfaces which mate with corresponding ends of the second weight.

15. A weight lifting system, comprising:

a weight having an upstanding first end with an aperture extending therethrough, an upstanding second end with an aperture extending therethrough, and a cross member extending between the first end and the second end;

a handle comprising a grip configured to be grasped by a user, the grip having a channel extending from a first end of the grip to an opposing second end of the grip;

a pair of rods movably disposed within the channel of the grip, the rods being configured to selectively attach the weight to the handle, each rod having teeth formed along the length thereof; and a pinion gear pivotally coupled to the handle, the pinion gear disposed between the rods, the teeth of each rod engaging the pinion gear; and a knob slidably engaged on the grip and coupled to one of the rods movably disposed within the channel of the grip, the knob being selectively depressable by a digit on the hand with which the user grasps the grip, whereby the user is enabled to selectively slide the knob with the digit, thereby causing the pair of rods to selectively attach the weight to the handle.

16. A weight lifting system as recited in claim 15, further comprising:

a second weight having an upstanding first end with an aperture extending therethrough, an upstanding second end with an aperture extending therethrough, and first and second cross members extending between the first end and the second end, the second weight being configured to receive the first weight between the ends thereof such that the apertures in the upstanding first ends of the first and second weights and the apertures in the upstanding second ends of the first and second weights are in axial alignment, and such that the cross member of the first weight is disposed between the first and second cross members of the second weight.

17. A weight lifting system as recited in claim 16, wherein the first weight is affixed to the handle.

18. A weight lifting system as recited in claim 15, wherein the handle further comprises first and second end plates coupled to opposing sides of the grip, and wherein the first and second end plates each have a slot in a lower portion thereof, the slot configured to receive the cross member of the first weight and the cross members of the second weight.

19. A weight lifting system, comprising:

a weight having an upstanding first end, an upstanding second end, and a cross member extending between the first end and the second end;

a handle comprising a grip configured to be grasped by a user, the grip having a channel extending from a first end of the grip to an opposing second end of the grip;

first and second rods movably disposed within the channel of the grip, the first and second rods being configured to selectively attach the weight to the handle; and means for selectively, simultaneously advancing the first and second rods out of opposing ends of the grip, the handle further comprising first and second plates coupled to the first and second ends of the grip respectively, the first and second ends of the grip being coupled to central portions of the first and second end plates, respectively, such that the opposing first and second ends of the grip are located away from the peripheral edges of the respective end plates.

20. A weight lifting system as recited in claim 19, wherein the means for selectively, simultaneously advancing the first and second rods out of opposing ends of the grip comprises a knob coupled to the first rod, the knob being selectively movable by a digit on the hand of a user used to grasp the grip.

21. A weight lifting system as recited in claim 20, wherein the grip includes a plurality of longitudinally aligned slots formed within the channel and wherein the knob is configured to selectively engage a desired slot, thereby maintaining the rod in a desired orientation with respect to the grip until the knob is selectively moved from the slot by a user.

22. A weight lifting system as recited in claim 21, wherein the knob is springloaded, the knob being selectively depressed in order to move the knob between slots.

23. A weight lifting system as recited in claim 20, wherein the grip includes first and second rows of longitudinally aligned slots formed within the channel, the knob including first and second flanges configured to selectively extend into respective first and second rows of slots.

24. A weight lifting system as recited in claim 19, wherein the first and second end plates each have a slot in a lower portion thereof, the slot configured to receive the cross member of the first weight and the cross members of the second weight.

25. A weight lifting system as recited in claim 19, further comprising a cross member extending between the first and second end plates.

26. A weight lifting bar as recited in claim 19, wherein the first and second end plates each have a slot in a lower portion thereof.

27. A weight lifting system as recited in claim 35, wherein the means for selectively, simultaneously advancing the first and second rods out of the opposing ends of the grip is located on the grip, and wherein the means for selectively, simultaneously advancing the first and second rods out of opposing ends of the grip further comprises a knob slidably engaged with the grip.

* * * * *

UNITED STATES PATENT AND TRADEMARK OFFICE

CERTIFICATE OF CORRECTION

PATENT NO. : 6,228,003 B1 
DATED : May 8, 2001
INVENTOR(S) : Patrick J. Hald, William T. Dalebout and F. Troy Miller It is certified that error appears in the above-identified patent and that said Letters Patent is hereby corrected as shown below:

Title page,
Item [57], ABSTRACT,
Line 11, after "the weight. The" change "mechanism" to -- means --

Column 8,
Line 4, after "embodiment of" insert -- the --

Column 11,
Line 8, after "of the" change "handle" to -- grip --
Lines 16, 18 and 25, after "claim" change "11" to -- 10 --

Column 12,
Line 57, after "claim" change "35" to -- 19 --

Signed and Sealed this

Sixteenth Day of July, 2002

*Attest:*

*Attesting Officer*

JAMES E. ROGAN
*Director of the United States Patent and Trademark Office*